US005472342A

United States Patent [19]

Welsh, II et al.

[11] Patent Number: 5,472,342

[45] Date of Patent: Dec. 5, 1995

[54] KITCHEN EXHAUST HOOD GREASE EXTRACTOR

[75] Inventors: Clarke T. Welsh, II; Ronald R. Huffman; C. Scott Brown, all of Logansport; R. Daniel Richeson, Lucerne, all of Ind.

[73] Assignee: LDI, Mfg. Co., Inc., Logansport, Ind.

[21] Appl. No.: 182,434

[22] Filed: Dec. 27, 1993

[51] Int. Cl.[6] ..... F24C 15/20

[52] U.S. Cl. ..... 126/299 E; 126/299 K; 126/299 F; 126/299 D

[58] Field of Search ..... 126/299 E, 299 D, 126/299 F, 299 R

[56] References Cited

U.S. PATENT DOCUMENTS

| | | |
|---|---|---|
| 722,272 | 3/1903 | Baker . |
| 1,616,802 | 2/1927 | Hosch . |
| 1,807,378 | 5/1931 | Budil . |
| 1,896,656 | 2/1933 | Anderson . |
| 2,277,670 | 3/1942 | Weisgerber . |
| 2,545,672 | 3/1951 | Pearson . |
| 2,813,477 | 11/1957 | Gaylord . |
| 3,055,285 | 9/1962 | Gaylord . |
| 3,207,058 | 9/1965 | Gaylord . |
| 3,324,629 | 6/1967 | Graswich et al. . |
| 3,564,989 | 2/1971 | Williams . |
| 3,616,744 | 11/1971 | Jensen . |
| 3,628,311 | 12/1971 | Costarella . |
| 3,731,462 | 5/1973 | Costarella et al. . |
| 3,796,549 | 3/1974 | Hall . |
| 3,802,158 | 4/1974 | Ohle . |
| 3,827,343 | 8/1974 | Darm . |
| 3,907,525 | 9/1975 | King . |
| 3,982,588 | 9/1976 | Darm . |
| 3,984,505 | 10/1976 | Gutermuth et al. . |
| 4,022,118 | 5/1977 | Vandas . |
| 4,050,446 | 9/1977 | Giuffre . |
| 4,084,947 | 4/1978 | Ear . |
| 4,200,087 | 4/1980 | Welsh . |
| 4,231,765 | 11/1980 | Scott . |
| 4,259,945 | 4/1981 | Lawson . |
| 4,274,845 | 6/1981 | Howard . |
| 4,323,373 | 4/1982 | Fritz . |
| 4,351,652 | 9/1982 | Wisting . |
| 4,484,563 | 11/1984 | Fritz et al. . |
| 4,635,617 | 1/1987 | Simonsen . |
| 4,738,244 | 4/1988 | Welsh . |
| 4,753,218 | 6/1988 | Potter . |
| 4,869,236 | 9/1989 | Blough . |
| 4,900,341 | 2/1990 | Csabai . |
| 5,069,197 | 12/1991 | Wisting . |

FOREIGN PATENT DOCUMENTS

| | | |
|---|---|---|
| 2399268 | 8/1977 | France . |

*Primary Examiner*—Larry Jones

*Attorney, Agent, or Firm*—Woodard, Emhardt, Naughton, Moriarty & McNett

[57] ABSTRACT

A grease collector housing is mounted directly atop a filter-containing kitchen exhaust hood at the exhaust collar. The housing includes a liquid reservoir at the bottom, a 360 degree shallow conical spray head immediately above the reservoir, an array of baffle-type grease filters above the spray, a filter-cleaning spray head above the array and a connector above it to the exhaust duct. A detergent water supply and removal system includes a pump and associated valving for moving a water-based solution through the spray heads and sprays as and when needed to remove grease from kitchen exhaust fumes and to wash down any residual grease from the filters and reservoir in the housing. A disposable cartridge-type water filter is included in the recirculating liquid system. Controls automatically provide the proper valve operating sequence for the operations as and when needed.

23 Claims, 5 Drawing Sheets

KITCHEN EXHAUST HOOD GREASE EXTRACTOR

BACKGROUND OF THE INVENTION

1. Field of the Invention

This invention relates generally to air handling equipment, and particularly to a device for removal of grease from the exhaust fumes from a kitchen exhaust hood.

2. Description of the Prior Art

Various devices have been designed and manufactured for removal of fumes from a kitchen. A common type is a canopy hood situated above a cooking appliance or appliances and which is connected through an exhaust duct to a roof-mounted blower which pulls air from the hood and discharges it above the roof. Such units typically have sets of removable baffle-type grease filters mounted in the hood itself and which can be removed periodically from the hood and washed in a sink or otherwise to remove accumulated grease from them. It is well known that such filters do not remove all of the grease. The result is that the grease which passes through such filters accumulates in the ductwork from the hood to the roof-mounted blower. It also accumulates in the blower itself and associated components. Eventually some accumulated grease from the blower or blower-mounting curb runs down onto the roof of the building. This creates an unsightly appearance, to say nothing of the potential fire hazard from grease which has accumulated in the duct above the filters.

Various arrangements have been proposed for removing grease from the fumes entering a kitchen exhaust hood. One approach is a water wash canopy hood. An example is shown in U.S. Pat. No. 4,753,218 issued Jun. 28, 1988 to Gary J. Potter. That patent identifies many prior art patents, some of which disclose various water wash hood systems. The patent also identifies manufacturers of various systems. The Potter patent emphasizes a cone shaped spray of cold water and detergent solution inside the hood itself and through which fumes are to pass. Water recirculation is also specified. Some water wash systems are custom made for the particular kitchen or combination of kitchen equipment items to be handled. They tend to be large and expensive.

There are many conventional hoods which cannot be used satisfactorily with charbroilers. Too much grease gets through them into ductwork, rooftop blowers and out into the air. There is no convenient way to adapt them to handling the fumes generated by charbroilers. U.S. Pat. No. 4,323,373 issued Apr. 6, 1982 to Frederick F. Fritz discloses a filter box mounted on top of a canopy hood to remove grease from the exhaust air. It proposes continuous wash down of Dacron fiber filters by a cold water/detergent solution. There remains a need for a better system which can be used with conventional hoods already in place but employed as a retrofit item between the hood and the exhaust ductwork, for removing from the exhaust fumes, the grease which passes the conventional baffle-type grease filters in the hood. The present invention addresses that need.

SUMMARY OF THE INVENTION

Described briefly, according to a typical embodiment of the present invention, a grease collector system includes a collection housing and associated detergent water-based liquid solution supply and return system and controls. The housing is mounted directly atop a filter-containing hood at the exhaust collar. The housing includes a liquid reservoir at the bottom, a 360 degree shallow conical spray immediately above the liquid reservoir, an array of grease filters above the spray, a filter-cleaning spray head above the array and a connector above it to the exhaust duct. The detergent liquid supply and removal system includes a pump and associated valving for moving liquid through the spray heads and sprays as and when needed to remove grease from kitchen exhaust fumes and to remove grease from the filters and reservoir in the housing. A disposable cartridge-type liquid filter is included in the liquid system. The controls provide the proper valve operating sequence for the operations as and when needed.

DESCRIPTION OF THE PREFERRED EMBODIMENT

Figure 1:
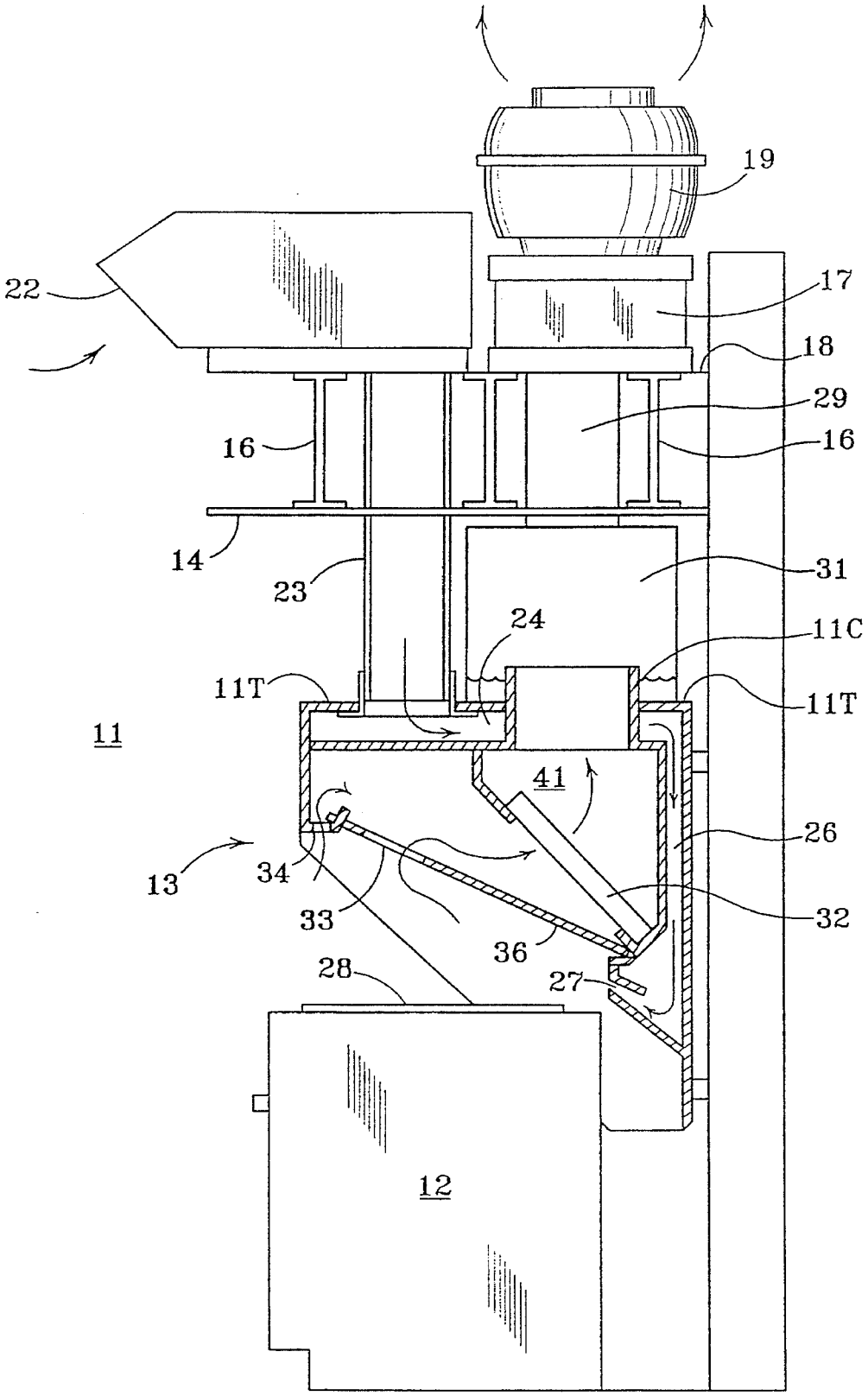
FIG. 1 is a schematic diagram of a kitchen exhaust system incorporating a grease extractor system according to a typical embodiment of the present invention.
Figure 2:
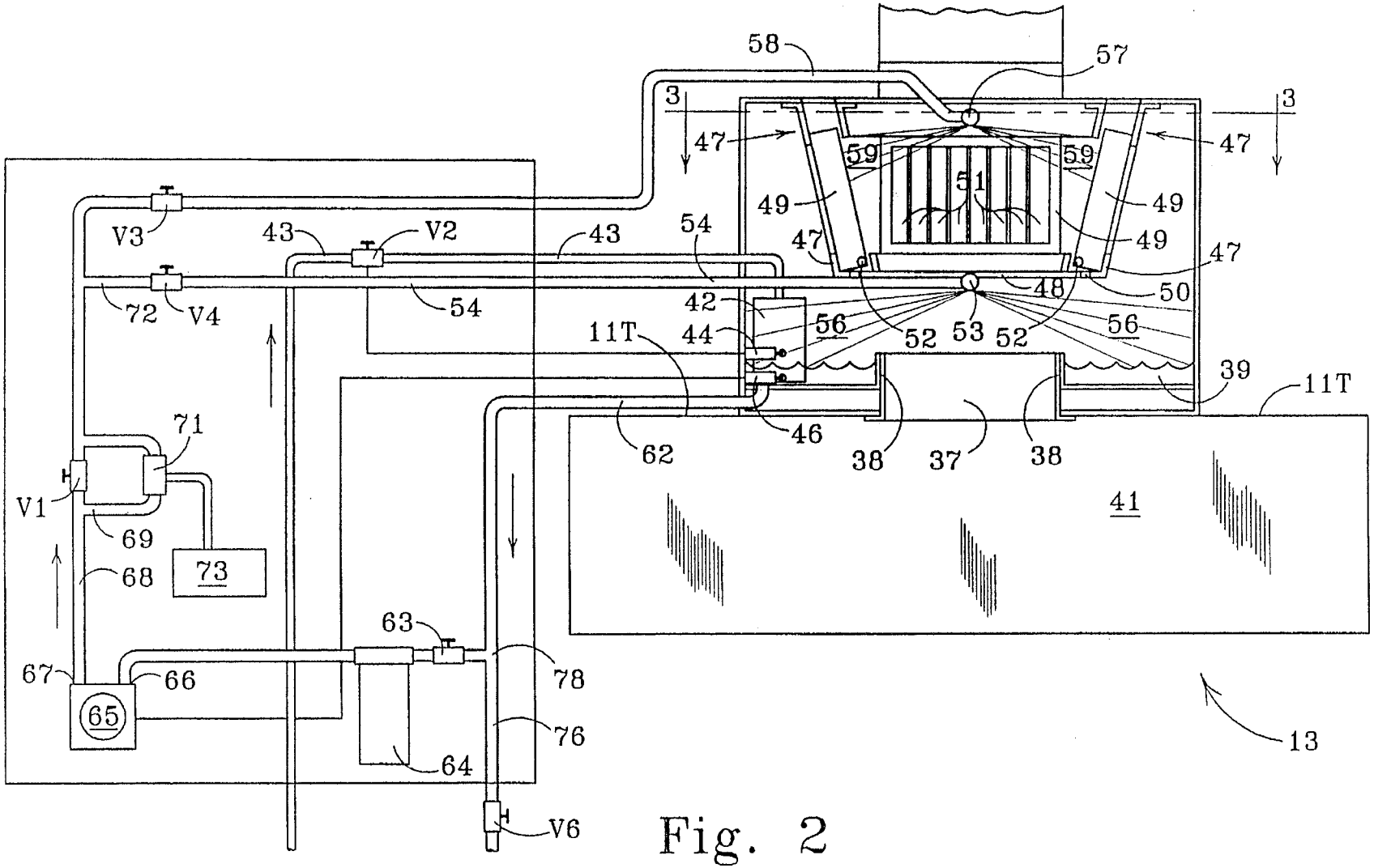
FIG. 2 is a schematic diagram of the grease extractor system.
Figure 3:
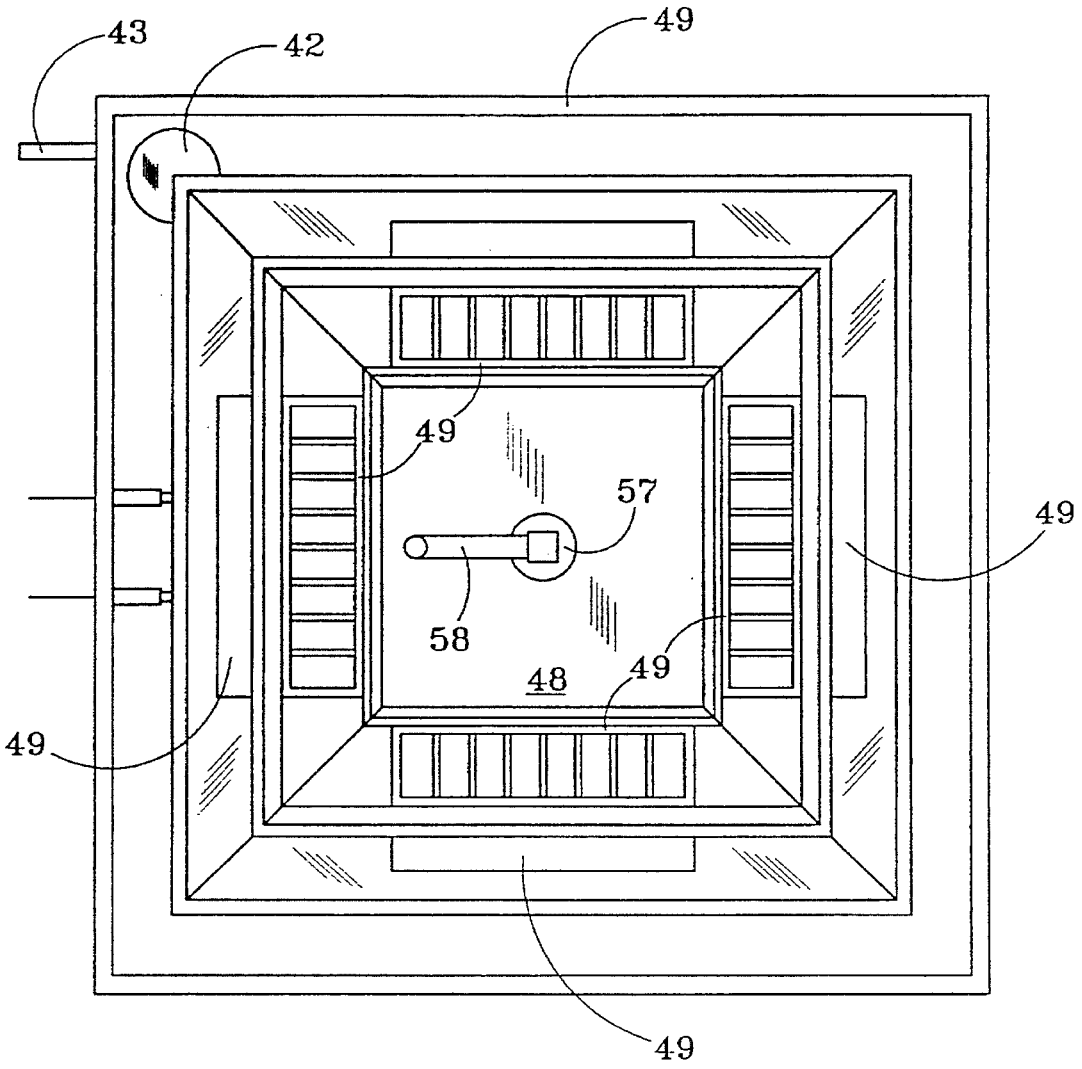
FIG. 3 is a cross sectional view through the grease extractor housing assembly taken at line 3—3 in FIG. 2 and viewed in the direction of the arrows.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 shows a part of a part of a conventional building kitchen 11 in which there is a cooking unit 12 (a charbroiler, for example). An exhaust hood 13 is mounted over the charbroiler. The suspended ceiling 14 of the kitchen is supported by the roof-supporting overhead joist assemblies 16. A curb 17 is mounted on the roof 18 and supports an exhaust blower 19. A make-up air blower unit 21 has an intake at 22. The blower 21 is coupled to the top 11T of the hood by ductwork 23. It supplies make-up air through passageways 24 and 26 in the top and back of the hood and the make-up air is discharged upwardly and forwardly through slot 27 into the area where the fumes are generated over the grille 28.

The exhaust blower 19 is coupled through ductwork 29 to the grease extractor housing 31 of this invention. The extractor housing is connected to exhaust collar 11C on the top 11T of the hood.

The hood is shown with a set of conventional baffle-type grease filters 32. A preferred direction of flow of air and fumes is provided to those filters through intake slots 33 and 34 by a means of a slotted baffle 36 at the plenum of the hood, with make up air being provided at the slot 27 below the baffle. Examples of slot and baffle arrangements are shown in U.S. Pat. No. 4,200,087 issued on Apr. 29, 1980 and U.S. Pat. No. 4,738,244 issued Apr. 19, 1988 to Clarke T. Welsh.

According to a typical embodiment of the present invention, a grease extractor housing 31 is mounted on top of the hood at the exhaust collar 37 to which, in the absence of the present invention, the duct to the exhaust blower was connected. This housing is arranged so that it has a square central opening in the bottom which fittingly receives the typically square exhaust collar 37 of the hood. This opening has an upwardly extending flange 38 around it such as to provide a rectangular reservoir 39 containing liquid but with a central opening therein through which air can come up from the plenum 41 above the filters in the exhaust hood. This reservoir or sump has a float-controlled fill valve 42 connected to a supply pipe 43 from the community water service. It also has two float-controlled magnetic reed switches, one 44 of which is a high liquid level sensor serving as an overfill avoidance safety switch, and the other 46 of which is a low liquid level sensor serving as a pump-disabling switch.

There is a generally rectangular framework 47 with closed bottom 48 mounting an array of four conventional, permanent baffle-type grease filters 49 installed with the filter baffles 51 running in a generally vertical manner and the filter drain holes 52 located in the bottom rail of the filters. The frame and filter array has a somewhat inverted frusto-pyramidal arrangement. This array is spaced above the exhaust collar a sufficient distance to provide room for a spray head 53 and supply pipe 54. Accordingly, the filter array defines an air/fume entry chamber in the housing between the hood exhaust collar and the filter array, and an air exit chamber above the array for the filtered air to move to the exhaust blower. The spray head is centrally located above the collar and under the array of filters and it is designed to provide a 360 degree generally shallow conical liquid spray 56. It is arranged such that the spray contacts the inner surface of the four walls of the housing above the reservoir and, in effect, partitions the entry chamber so that all of the fume-bearing air entering the chamber must pass through the spray before it gets to the filter array. A spray head 57 and supply pipe 58 are mounted above the array of filters and provide a similar spray pattern 59 inside the array when desired for a filter cleaning mode.

The liquid supply system includes the water service connection 43 as indicated above, together with the float-controlled fill valve 42. In addition, there is a normally-closed solenoid-operated valve V2 in the water supply line and associated with high liquid level sensor switch (HWLS) 44 to prevent overflow in case of failure of valve 42.

There is a return line 62 from the reservoir through a manual shutoff valve 63 and cartridge filter assembly 64 to the pump 65 intake side 66. The pump discharge outlet 67 is connected through line 68 and valves V1 and V3 and line 58 to the filter cleaning nozzle 57. The discharge outlet of the pump is also connected through line 72 and valve V4 and line 54 to the spray nozzle 53.

The cartridge filter assembly includes a one-hundred micron replaceable filter cartridge. The manual shutoff valve 63 is located above the intake side of the filter to facilitate removal of the filter cartridge without dumping all of the liquid from all of the lines above the filter.

A system drain line 76 is provided, with valve V6 below the wye-type junction 78 so that, when desired, the liquid which would normally return from the reservoir to the pump can be drained directly to a collector or sewer. The control and sequencing of the various valves can be done either by electrical-mechanical means with timed relays or by a programmed computing controller. The typical sequence is described hereinafter, with the operation using timing relays described as "Operation 1", and that using the programmable controller described as "Operation 2."

OPERATION 1

Figure 4:
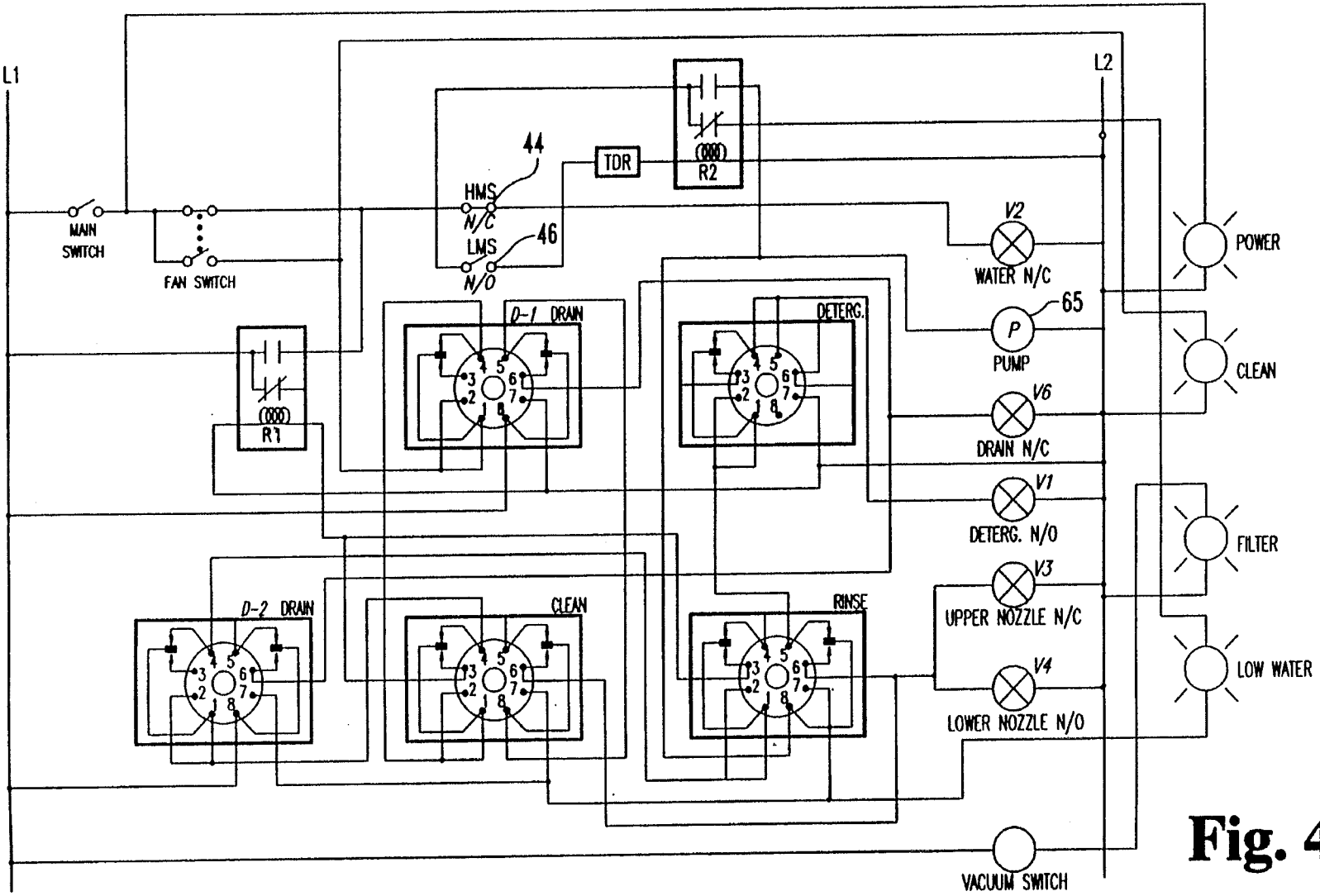
FIG. 4 is an electrical schematic diagram using timing relays for sequencing.
Figure 5:
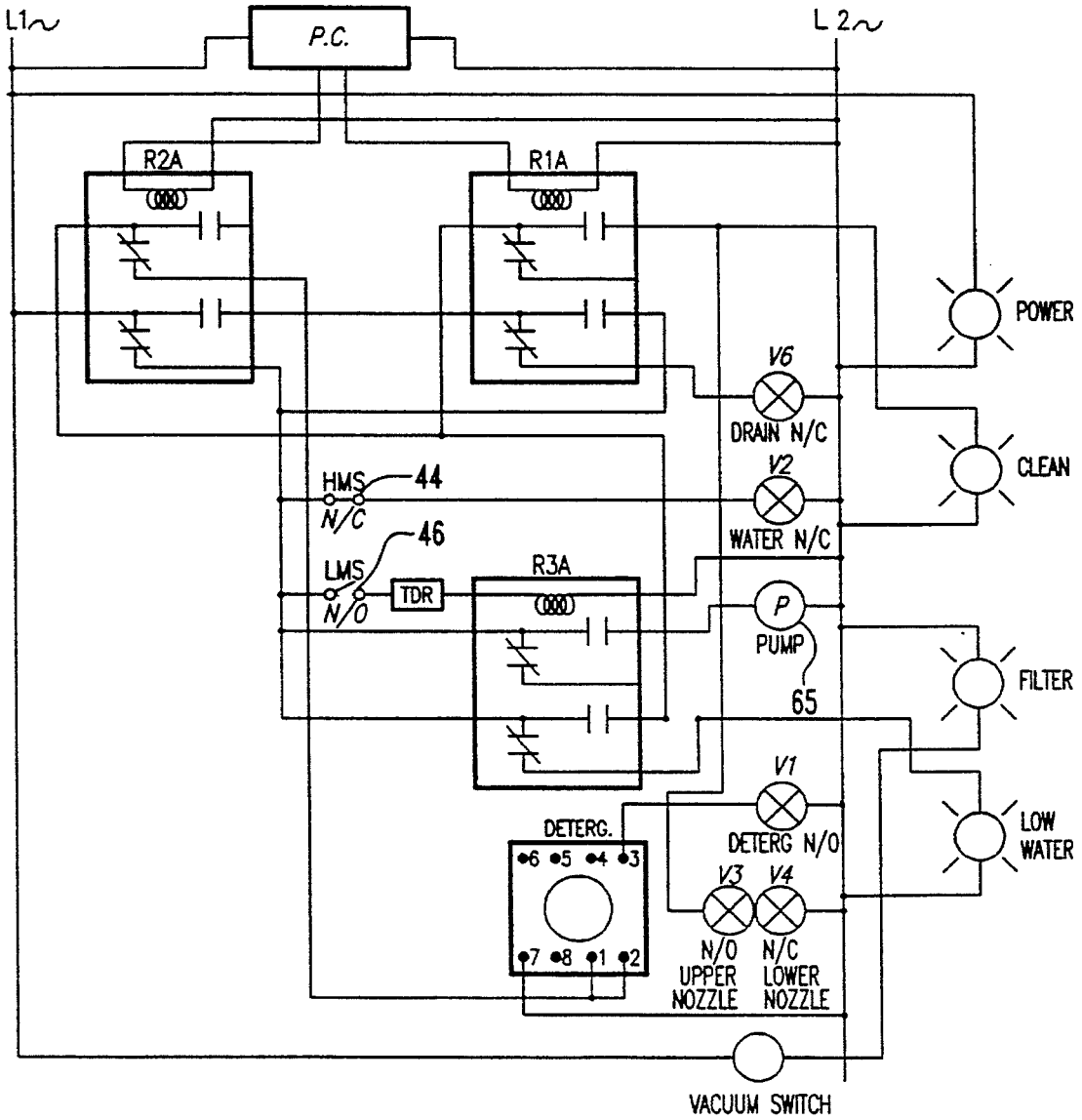
FIG. 5 is an electrical schematic diagram of an alternate embodiment using a programmable controller for sequencing.

This FIG. 4 control is designed around individual timing relays to achieve sequencing for the various functions involved in operation of the system. There are four basic functions:

1. NORMAL OPERATION with liquid spraying through the lower scrubber nozzle, and with periodic detergent injection to continually emulsify the grease.
2. A DRAIN CYCLE wherein the pump is turned off and the sump of the housing drains to the sewer/grease trap.
3. A CLEAN CYCLE where the pump is reactivated using fresh water and detergent, and the solution is sprayed through the upper nozzle behind the filter baffles.
4. A RINSE CYCLE where the pump is again activated with clean liquid which is sprayed through the upper nozzle.

Referring to the control schematic FIG. 4, power is supplied when the MAIN SWITCH (single pole/single throw) is closed, also causing the POWER indicator lamp to light. The FAN SWITCH (double pole/double throw) is shown in the position for NORMAL OPERATION. The connections from the FAN SWITCH to the fan 19 are not shown here, as they can be conventional. At the beginning of NORMAL OPERATION, power is supplied through the high liquid level switch (HWLS) 44 to the normally-closed (N/C) solenoid-operated water valve V2, whereby the valve is opened. The sump of the housing 39 fills with water through the mechanical liquid level valve 42 (not part of this electrical control system), which is intended to maintain a predetermined level of liquid in the sump.

When the liquid level reaches a point where the low liquid level sensor switch (LWLS) 46 closes, power is applied to a solid-state time delay relay (TDR). This delay of power to relay R2 for approximately 15 seconds allows the liquid level to rise above the closure point of LWLS 46, preventing the pump 65 (which is turned on when R2 closes) from shutting down prematurely due to suction of liquid back below the closure level of LWLS 46.

When power is applied to the pump, it is also applied to the cycling relay labeled DETERG., through contacts in the RINSE relay. The DETERG. relay has programmable ON and OFF times so that there is a short ON period, applying voltage to the normally open, solenoid-operated detergent valve, Vl, followed by a long OFF period. This results in a burst of water in the valve by-pass line 69 through the detergent injector 71 thereby drawing detergent from tank 73 into the water whereby detergent enters the spray stream periodically (as determined by operation of valve V1) during the grease removal (scrubbing of the air stream) process, such that the grease in the liquid tends to be emulsified. This process of scrubbing, NORMAL OPERATION, with periodic detergent injection continues so long as the hood is on and the fan is running. Note that any time when the pump is operating, should the liquid level fall below that determined by the setting of the LWLS 46, the pump will shut down and the LOW WATER light will be illuminated.

When operation of the kitchen is complete for the day, or a slack time is reached, the operation of the grease extractor system is switched to a cleaning mode. To do this, the FAN SWITCH is changed such that the fan goes off and the normally-open contacts are closed, placing voltage on terminals 1 and 2 of the D-1 DRAIN relay, causing its contacts to transfer, for a pre-set period of time to allow the contents of the sump to drain. Power is also directed from the fan switch to the CLEAN lamp, indicating that the system is in the cleaning mode. With the transfer of the contacts of the DRAIN relay D-1, power is applied from terminal 8 and through the contacts and through terminal 6 thereof to the solenoid of the normally closed DRAIN valve V6, causing it to open.

When an adequate time (pre-set) has elapsed to complete the draining of the sump, the contacts of the D-1 DRAIN relay return to the normal state and power is directed through terminal 1, the contacts and terminal 4 of the D-1 DRAIN relay to terminals 1 and 2 of the CLEAN relay . This causes the contacts of the CLEAN relay to transfer for the pre-set period of time necessary to accomplish the cleaning process.

Power is applied through terminal 3 and the associated contacts of the CLEAN relay to relay R1, which switches to apply voltage to the input side of the liquid level limit switches, HWLS 44 and LWLS 46. Then, the operation of the pump and periodic detergent injection are activated in the same manner as was the case for NORMAL OPERATION. Also power is applied through terminal 6 of the CLEAN relay to the valves V3 and V4, which shunt the flow of liquid and detergent into the upper nozzle.

When the CLEAN relay times out, the contacts revert to the original position and power is applied to terminals 1 and 2 of the second (D-2) DRAIN relay from terminal 4 of the CLEAN relay. As was the case when the previous DRAIN CYCLE occurred, everything else is off except for the DRAIN valve V6.

After sufficient time for complete drainage elapses, the contacts in the D-2 DRAIN relay revert to the original position and power is applied from terminal 4 thereof-to terminal 1 and 2 of the RINSE relay. The contacts of the RINSE relay then transfer, which then applies power through terminal 3 to R1 so that water is again admitted to the sump and the pump becomes operational when the water level is adequate. Power is also applied through terminal 6 of the RINSE relay to valves V3 and V4 causing the liquid to spray through the upper nozzle. Note that power can no longer pass through terminal 5 of the RINSE relay so that the detergent injection is off.

When the RINSE relay times out, the CLEAN CYCLE is complete and the system is ready to have the fan turned back on and the NORMAL OPERATION resumed. The switching from fans and NORMAL OPERATION to CLEAN CYCLE can be accomplished manually as shown, or an automatic, timed switching can be incorporated.

OPERATION 2

This control is designed around a programmable controller, P.C., which provides timing for the various functions. In the same manner as VERSION 1 there are four functions:

1. NORMAL OPERATION with liquid spraying through the scrubber nozzle, and with periodic detergent injection to continually emulsify the grease.
2. A DRAIN CYCLE wherein the pump is turned off and the sump of the grease extractor drains to the sewer/grease trap.
3. A CLEAN CYCLE where the pump is reactivated using fresh water and detergent, and the solution is sprayed through the upper nozzle behind the filter baffles.
4. A RINSE CYCLE where the pump is again activated with clean liquid which is sprayed through the upper nozzle.

The P.C. being used in this instance has two single pole/double throw relay outputs, which are connected to two double pole/double throw relays. Other P.C.'s with at least two such output relays, or even more manual actuation, may be used to control the two DPDT relays, R1A, R2A and R3A which, in turn, determine which of the four functions are activated.

The output states of the P.C. can be defined as follows:

| | | | |
|---|---|---|---|
| 1. Both relays OFF | 0 | 0 | NORMAL OPERATION |
| 2. R1A ON, R2A OFF | 1 | 0 | CLEAN CYCLE |
| 3. R1A OFF, R2A ON | 0 | 1 | DRAIN CYCLE |
| 4. R1A ON, R2A ON | 1 | 1 | RINSE CYCLE |

With both relays OFF, voltage is applied through the normally closed contacts of R2A to the high liquid level switch (HWLS) 44, and to the water valve V2, causing water to begin filling the sump. When sufficient water is present to close the low liquid level switch (LWLS) 46, power is directed through the time delay relay, TDR, to relay R3A. When the pre-set time for the TDR elapses, typically 10 to 15 seconds, the contacts of R3 transfer, turning on the pump 65 and applying voltage to a normally closed contact in R2A which, in turn, applies voltage to terminals 1 and 2 of the DETERG. relay. The DETERG. relay is a cycling relay which turns on solenoid valve V1 for a brief period to shut the valve and inject detergent into the water stream, and then turns off for a much longer pre-set time. As long as voltage is applied to this relay the periodic detergent injection continues.

When the time for a cleaning cycle is reached, as determined by the programming of the P.C., R2A is turned on and the DRAIN CYCLE is initiated. Voltage is applied through the normally-open (N.O.) contact in R2 and the normally-closed (N.C.) contact in R1A to the DRAIN valve solenoid, V6. Draining continues for the pre-set period of time that assures complete drainage of the sump.

After draining the sump, the P.C. turns R1A "ON" and R2A "OFF", initiating the CLEAN CYCLE. This causes power to again be applied to the HWLS 44 and hence to the valve V2. As before, when the liquid level activates the LWLS, the pump is turned on through R3A, and the DETERG. relay is also activated through N.O. contacts in R3A and N.C. contacts in R2A. Also valves V3 and V4 are activated through N.O. contacts of R1A so that the liquid spray is directed into the upper nozzle 57 behind the baffles in the filter array.

When the CLEAN CYCLE is complete, as determined by pre-set time in the P.C., the DRAIN CYCLE is again initiated. R1A is turned off and R2A turned on so that voltage is applied to valve V6 until sufficient time for complete drainage has elapsed.

A RINSE CYCLE then occurs with both relay R1A and R2A turned on. Now voltage is applied to HWLS 44 and V2, causing the sump to fill. As before, when the liquid closes LWLS 46, R3A is turned on after the pre-set time determined by TDR. Voltage then goes through the N.O. contacts of R3A to the pump, and to valves V3 and V4 through the N.O. contact of R1A. note that R2A being "ON" prevents voltage from reaching the DETERG. relay, so that only water is sprayed through the upper nozzle to rinse away residual detergent solution.

When the RINSE CYCLE is complete, the sump 39 may again be drained or the system can revert directly to NORMAL OPERATION.

Drain holes 50 are provided in the filter retaining channels on the bottom 48 of the filter array and located outboard of a vertical upward projection of the outline of the exhaust collar, so liquid draining from the filters during the CLEAN and RINSE cycles will return to reservoir 39.

An example of the spray nozzles 53 and 57 is the number ⅜ E 15 of Spraying System Co. of Wheaton, Ill. An example of the baffle filters 49 is a Flame Gard brand UL listed such as shown in U.S. Pat. No. 3,566,585 for example. Another is Fire Fighter brand UL classified such as shown in U.S. Pat. No. 3,910,782. To obtain less static pressure rise ahead of the filters, mesh filters are used instead of baffle filters. Examples of such filters with metal mesh are the Perma-Steel Steel Smith model made by Smith Filter Corporation. The preferred liquid flow through the nozzle 53 is about 3 gallons per minute (gpm) at 70 pounds per square inch (psi). An example of the liquid filter cartridge is Amatek Big Blue P/N 150237. An example of the detergent is Ecolab Ultraklene. An example of the grease injector is Dema 203-C.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A grease collector system for a fume collecting hood coupled to an exhaust blower and comprising:

a housing mountable between the hood and the exhaust blower;

an array of permanent-type filters removably mounted in the housing and defining a vertically extending boundary for filtering Of air passing generally horizontally between an air entry chamber and an air exit chamber;

a first spraying device located in the entry chamber and arranged to establish a chamber-partitioning spray in the entry chamber;

an air inlet in the housing below the partitioning spray to admit fume-bearing air to the air entry chamber;

a wall in the entry chamber and arranged with respect to the filter array to force air entering the housing through the inlet to pass through the spray before entering the filters; and an outlet in the housing above the array and communicating with the exit chamber to receive air that has passed through the spray and filters.

2. The system of claim 1 and wherein:

the first spraying device includes a spray head at the bottom of the filter array producing a downwardly directed shallow conical spray of liquid from the center of the array to interior perimetrical walls of the housing.

3. The system of claim 1 and wherein:

the array of filters includes filters arranged on four sides of a rectangular frame and slightly inclined outward at their tops to a configuration of an inverted frustum of a pyramid.

4. The system of claim 1 and further comprising:

a reservoir in the housing containing liquid and arranged to collect liquid descending from the spray.

5. The system of claim 4 and wherein:

the reservoir and inlet are arranged so that liquid from the spray enters the reservoir outboard of the inlet.

6. The system of claim 5 and wherein:

the filter array is arranged so that liquid and grease collected on the filters are deposited in the reservoir.

7. The system of claim 5 and further comprising:

a second spraying device located at the top of the array and arranged to spray liquid on the interior of the filters in the array to clean them.

8. The system of claim 1 and further comprising:

a fume generating cooking appliance;

a fume collecting hood above at least a portion of the appliance; and an exhaust blower coupled to the housing outlet for pulling the fume-bearing air from inside the hood up through the partitioning spray in the housing and the filter array for cleaning there and then through the housing outlet to and through the blower.

9. The system of claim 8 and further comprising:

a building portion having a kitchen with the appliance therein, a ceiling above the hood and a roof above the ceiling;

the housing being between the top of the hood and the roof; and the blower being above the roof and discharging the air moved through it to the outside atmosphere.

10. The system of claim 9 and further comprising:

a liquid recirculating system including a reservoir in the housing and collecting liquid sprayed from the first spraying device and collecting grease being removed from the fume-bearing air entering the spray, and a pump moving liquid from the reservoir to the first spraying device.

11. The system of claim 10 and further comprising:

a detergent injector in the liquid recirculating system; and a controller periodically causing detergent to be injected in the the liquid moving from the reservoir to the spraying device.

12. The system of claim 10 and further comprising:

solenoid valves in the recirculating system; and timing means coupled to the valves and arranged for controlling the valves in sequence to establish normal operating conditions, a system cleaning condition, and a system rinsing condition.

13. A grease collector system for a fume collecting hood coupled to an exhaust blower and comprising:

a housing mountable between the hood and the exhaust blower;

a four-sided array of filters removably mounted in the housing the filters having generally vertically extending inlet faces;

a first spray apparatus located in the housing below the filters and arranged to produce a shallow conical spray of liquid having its center on a line centered in the array;

an air inlet below the spray apparatus to receive air and fumes from a fume generating device;

a wall above the spray apparatus and sealed to the bottom of the filter array to force air entering the housing through the inlet to pass through the spray of liquid before entering the filters;

an outlet above the array to receive air that has passed through the liquid spray and filters; and a second spray apparatus centered at the top of the array for spraying the inside of the filters with liquid.

14. The system of claim 13 and further comprising:

a liquid reservoir at the bottom of the housing; and a pump and associated liquid lines and valves for moving liquid through the spray apparatus and sprays as and when needed to remove grease from fumes and to remove grease from the filter and reservoir in the housing.

15. The system of claim 14 and wherein:

the first spray apparatus is arranged to produce a substantially 360 degree shallow conical spray immediately above the air inlet.

16. The system of claim 15 and wherein:

the second spray apparatus is a filter-cleaning spray apparatus and is arranged to produce a substantial spray covering the interior of the filter array.

17. The system of claim 16 and wherein:

the outlet is centered above the array and the second spray apparatus for connection to ductwork to an exhaust fan.

18. The system of claim 14 and further comprising:

controls coupled to the valves to provide the proper valve operating sequence for the operations as and when needed.

19. A method of removal of grease from the exhaust of a kitchen fume exhaust hood in a building and comprising the steps of:

directing the fumes into a housing atop the hood;

establishing a path of fume-bearing air flow through the housing from an inlet at the top of the hood, upward through an array of filters toward an outlet and;

establishing a liquid spray partition across the path and causing the fume bearing air to flow through the partition toward the the filters prior to entry into the filters to remove grease from the fume bearing air before reaching the filters.

20. The method of claim 19 and further comprising the step of:

collecting in the housing, liquid from the partitioning spray and recirculating the liquid and returning the liquid to the spray.

21. The method of claim 20 and further comprising the step of:

periodically adding detergent to the recirculating liquid for inclusion in the liquid spray.

22. The method of claim 19 and further comprising the step of:

periodically terminating the air flow and washing down the filter array by spraying the filters from inside the array.

23. The method of claim 22 and further comprising the step of:

spraying the filters from inside the array with a liquid/detergent solution.

* * * * *